US005510311A

United States Patent [19]

Bond et al.

[11] Patent Number: 5,510,311

[45] Date of Patent: Apr. 23, 1996

[54] CARBONLESS COPY MATERIAL

[76] Inventors: Michael P. Bond, Barnrooden Farm Shuckburgh Rd., Warwickshire CV238RY, United Kingdom; Victor G. Atkinson, 38, Dark Lane, Hollywood Birmingham, United Kingdom, B47 5BT

[21] Appl. No.: 302,785

[22] PCT Filed: Jan. 11, 1994

[86] PCT No.: PCT/GB94/00048

§ 371 Date: Sep. 12, 1994

§ 102(e) Date: Sep. 12, 1994

[87] PCT Pub. No.: WO94/15795

PCT Pub. Date: Jul. 21, 1994

[30] Foreign Application Priority Data

Jan. 13, 1993 [GB] United Kingdom ..... 9300555

[51] Int. Cl.[6] ..... B41M 5/128; B41M 5/132

[52] U.S. Cl. ..... 503/201; 427/152; 503/200; 503/206; 503/226

[58] Field of Search ..... 427/152; 503/200, 503/206, 226, 201

[56] References Cited

U.S. PATENT DOCUMENTS

| | | | |
|---|---|---|---|
| 4,097,619 | 6/1978 | Davis et al. | 427/44 |
| 4,112,138 | 9/1978 | Davis et al. | 427/54 |

*Primary Examiner*—B. Hamilton Hess
*Attorney, Agent, or Firm*—Plevy & Associates

[57] ABSTRACT

A sheet of copy material of the type having on one face (18*a*;28*a*) thereof a coating (B) incorporating a colour-forming substance of the kind which when released onto a receptor material (F) produces a visible mark, and having an opposite face (18*a*;28*b*) of the material free from such coating, characterised in that said one face (18*a*;28*a*) of the material comprises a visible image (I) formed thereon before the deposition of said coating (B), which is translucent, so that said visible image (I) is discernible through said coating (B) and in that said opposite face (18*b*;28*b*) carries a further image (II) formed thereon after the deposition of said coating (B) on said one face (18*a*;28*a*).

14 Claims, 3 Drawing Sheets

FIG 1
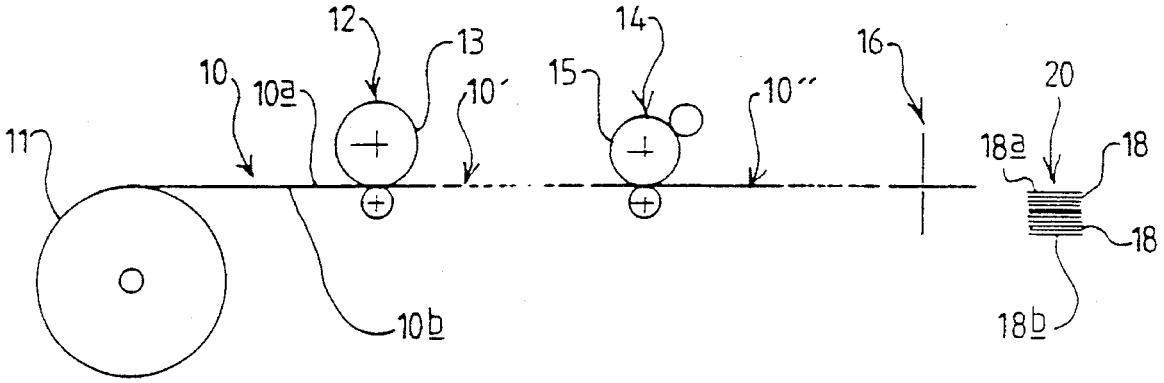
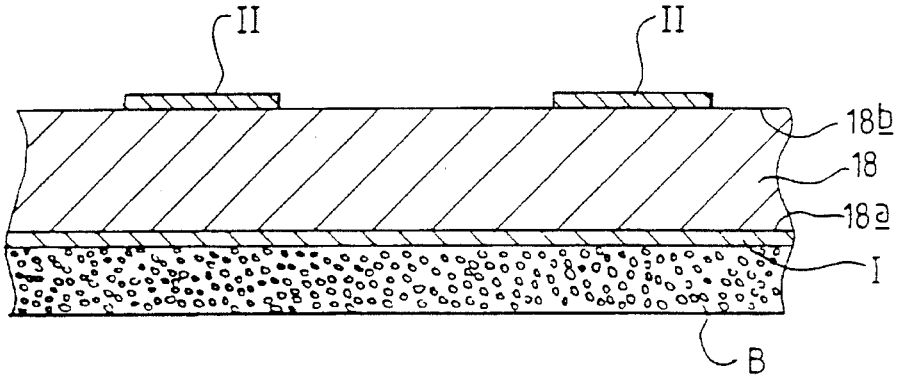
FIG 2

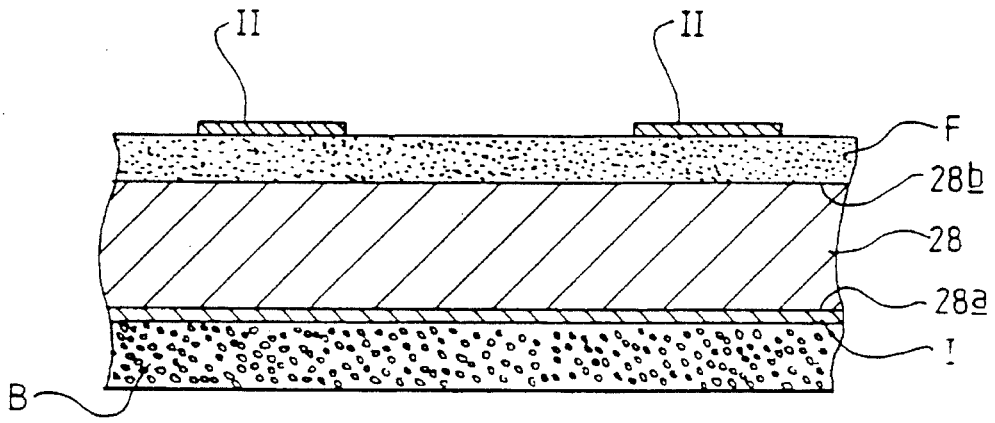
FIG 3
FIG 5
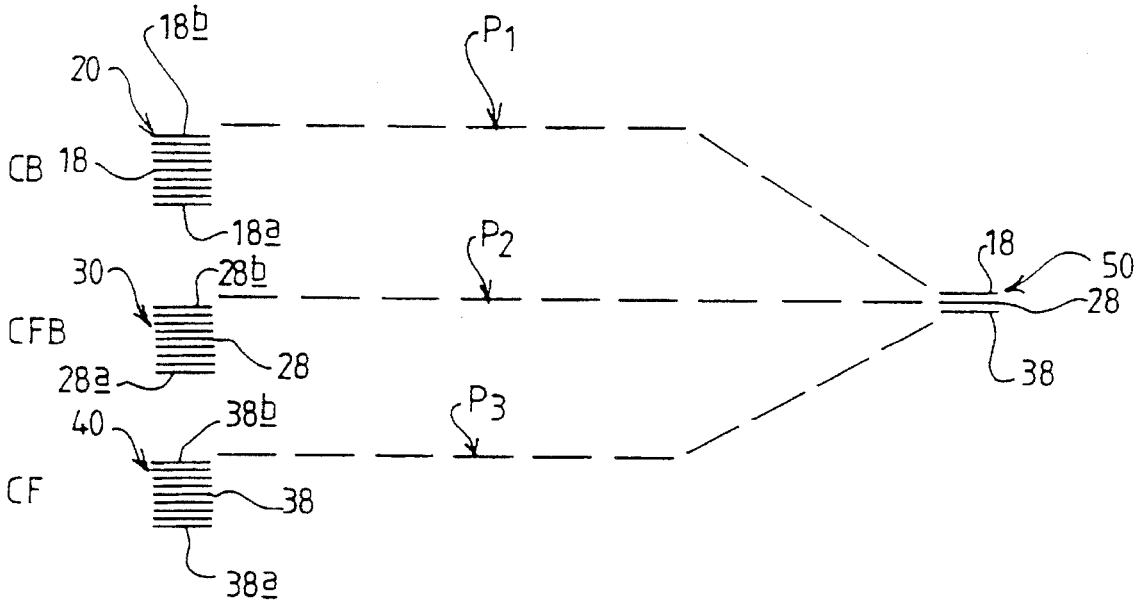

CARBONLESS COPY MATERIAL

DESCRIPTION OF THE INVENTION

This invention relates to copy materials of the type generally referred to as "carbonless" which generally rely on two coatings formed respectively on the contiguous faces of superimposed sheets of material such as paper, namely a coating containing a colour-forming substance, usually contained in rupturable micro-capsules or similar, on the back of the uppermost sheet(usually known as a CB sheet) and a coating of a receptor layer on the front of the lowermost sheet (usually known as a CF sheet). Colour-forming chemicals are typically dissolved in an oily solvent and encapsulated by well known techniques, and when such capsules are ruptured by mechanical pressure, as by impact of a type bar of a typewriter, the chemicals are released and react to form a visible mark on the coating of the adjacent CF sheet.

Instead of confining the colour-forming chemicals in micro-capsules, they may be contained in oil droplets emulsified into a continuous phase coating which is rupturable to release the chemicals in response to locally applied pressure.

Conveniently, paper for use in such copying systems is of three types, distinguished by their coatings, namely CB sheets having a colour-former coating on the underside to form the top sheet of a multi-part set, receptor layer sheets having a CF coating on the upper side to form the bottom sheet of such a set, and optionally CFB sheets having a receptor layer coating on the upper side and a colour-former coating on the underside to form one or more intermediate sheets of a set where required. Such coatings are normally applied by a continuous process to cover the entire area of the appropriate face of the sheet.

In recent years, there has been a demand for printing onto such coated paper as the recipient material in toner-based printing systems or the like in which an image is transferred to the recipient material electrostatically, a process sometimes known as "electronic or laser printing", or by other non-imact methods.

However, where the material is, as is usually the case, cut into sheets prior to such printing it is essential for the sheet material to be fed into the printing apparatus with the correct face uppermost. It will be appreciated that normally a stack of sheets is placed into a sheet feeder mechanism associated with the printing apparatus and if the stack is placed in an inverted position relative to that required for printing on the appropriate face of each sheet, then the production from the entire stack of sheets will be lost. In practice the visual appearance of the opposite faces of each sheet, and correspondingly the exposed faces of the sheets at opposite ends of such a stack, may not be readily differentiated and accordingly this risk is quite substantial. Moreover, the error may not be detected until the wrongly printed material is incorporated into multi-part sets, giving rise to even greater loss.

Additionally, there is a requirement in some cases to identify the paper, for example by means of a brand name analogous to a water mark, or to display other information concerning the material, such as its weight and/or composition and/or its coatings etc, in such a manner that it can be identified not only by the immediate user but also by subsequent recipients.

EP0027698 discloses a sheet material carrying an unobtrusive image and a method for producing same in which an ink jet technique is used to form such a image on ordinary uncoated paper, or on the uncoated face of CB or CF paper or on The coated face of CB, CF or CFB paper, the image being formed after the coating has been deposited on the paper and thus on top of the coating.

However, the intensity of the image which can be formed on such coatings without seriously impeding the function of the coating is strictly limited to the formation of unobtrusive images as detailed in the aforesaid specification, and accordingly such images are of minimal value in either identifying the material or conveying other information as called for above, and certainly not of value in readily distinguishing one face from the other.

Accordingly, in accordance with the invention we provide a copy material of the type having on one face of the material a coating incorporating a substance which when released onto a receptor material produces a visible mark, and having the opposite face of the material free from such a coating, characterised in that said one face of the material carries a visible image formed thereon before, the deposition of said coating, which is translucent, so that said visible image is discernable through the coating.

The term "visible image" is intended to encompass any form of mark in which it is visibly distinguishable from the paper or other material to which it is applied and is also distinguishable from the opposite face of the material or any coating thereon. The visible image may be formed as a continuous or discontinuous coating or by printing or other processes.

The visible image may extend substantially uniformly over all or part of said one face in order to afford a substantially uniform colour which is discernable through the colour-former coating, or it may be of a substantially non-uniform nature so as to present a pattern which is discernable through the coating, or it may define alphanumeric or other characters so as to convey information discernable through the coating, or it may display any combination of such attributes.

Such "visible image" should not be confused with the visible markings formed by the copy process on the other face when such material is used, nor with any other visible image which may be applied to the other face of the material as hereinafter mentioned.

Such copy material may be formed into a continuous roll after the coating operation, or it may be cut into individual sheets and formed into a stack in which each sheet is similarly orientated with regard to said face bearing the visible image. Alternatively, where the image is primarily intended for identifying the correct orientation of an entire stack of material prior to its insertion into a sheet feeder for subsequent printing onto a specified face of each sheet, a single sheet, or several sheets of coated material in accordance with the invention could be arranged at one end of a stack of otherwise conventional sheets of material,thereby facilitating the correct orientation of the entire stack.

Thus, in accordance with a further aspect of the invention we provide a stack of sheets of copy material of the type in which one face of each sheet has a coating incorporating a colour-forming substance of the kind which when released onto a receptor material produces a visible mark, all the sheets in the stack having the respective faces provided with said coating facing towards the same end of the stack, characterised in that at least one sheet at one end of the stack comprises such copy material so that the visible image on the end-most sheet is visible at one end of the stack.

The invention also resides in a sheet of copy material of the type having one face thereof a coating incorporating a colour-forming substance of a kind which when released onto a receptor material produces a visible mark, and having an opposite face of the paper free from such coating, characterised in that said one face of the material carries a visible image formed thereon before the deposition of said coating, which is translucent, so that said visible image is discernible through said coating and in that said opposite face carries a further image formed thereon after the deposition of said coating on said one face.

According to a still further aspect of the invention we provide a method of producing a copy material having on one face thereof a coating incorporating a substance which when released onto a receptor material produces a visible mark, and having an opposite face thereof free from such coating, characterised by the step of passing feed stock free from said coating on said one face successively and continuously through a first work station at which a visible image is formed on said one face and subsequently through a second work station in which said coating is applied to said one face and over said visible image whereby the visible image is discernible through said coating.

The invention will now be described by way of example with reference to the accompanying drawings wherein:

FIG. 1 illustrates diagrammatically a preferred method for producing a CB copy paper and forming sheets of such copy paper into a stack;

FIG. 2 is an enlarged fragmentary section through a sheet of CB copy paper produced by the method of FIG. 1;

FIG. 3 is an enlarged fragmentary section through a CFB sheet of copy paper produced by the same method;

FIG. 5 illustrates diagrammatically a preferred method of producing multi-part sets from such copy papers.

Figure 4:
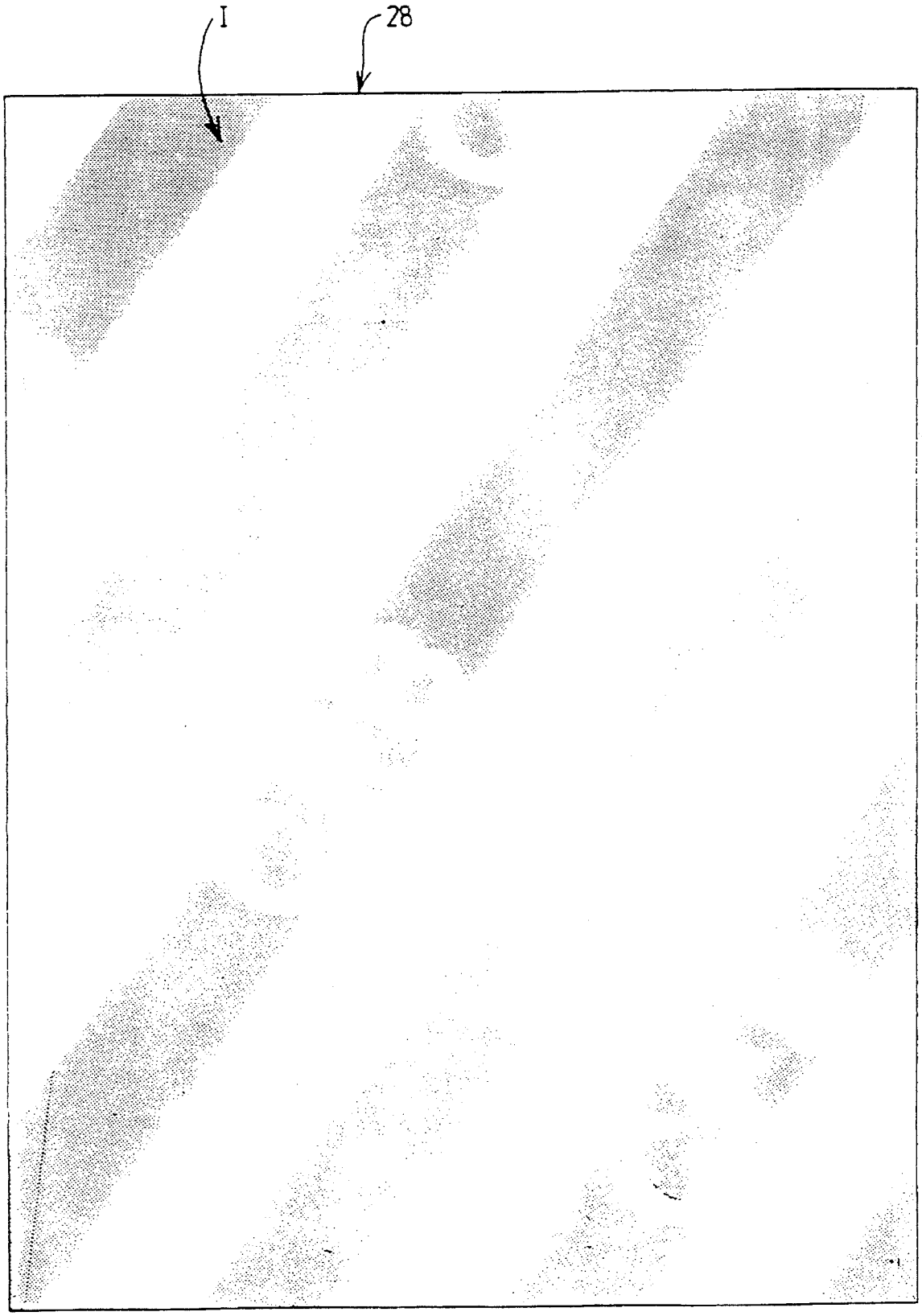
FIG. 4 illustrates such a sheet of CFB material and shows a typical visible image for distinguishing the face having the colour-former coating.

As illustrated in FIG. 1, a continuous web 10 of suitable material such as paper is drawn from a roll 11 of feed stock and passed through a first station 12 wherein a roller 13 applies a visible image (I) to the uppermost face 10*a* of the web. After any necessary drying/flattening stage (not illustrated) where predetermined curl might be introduced, the web 10' carrying the image (I) is then passed through a second station 14 at which a coating roller 15 applies a coating (B), of a kind which incorporates a colour-forming substance, to the uppermost face 10*a* of the web 10' on top of the image (I).

After any appropriate drying/flattening operations (not illustrated) where preferential curl might be introduced, the coated web 10" may be formed into a new roll, from which it can subsequently be unwound and cut longitudinally into a number of strips each corresponding in width to one dimension of desired sheets of paper to be formed therefrom, and subsequently passed through a cutting station 16 at which each strip is severed transversely to form individual sheets 18 which are formed into a stack 20, with the coated face 18*a* of each individual sheet facing in the same direction in the stack 20.

Instead of being formed into a roll after the application of the coating (B), the web 10" may be passed directly to the cutting station 16 in some instances.

The stack 20 may then be presented to the sheet feed mechanism of printing apparatus of a kind appropriate for carrying out a non-impact printing operation, e.g. by xerography or similar electrostatic imaging processes or by ink jet printing or the like, on the other face 18*b* of each sheet, the image (I) applied at station 12 to the face 10*a* of the web 10 facilitating the appropriate orientation of the stack as necessary to ensure that the required subsequent printing is carried out on the correct face of each sheet.

It will be understood that where the opposite face 10*b* of the web 10 is free from any coating (at least of a type which takes part in the copy process) the sheets 18 may serve for the production of CB sheets for use in a multi-part set. The sheets 18 in the stack 20 can be passed through printing apparatus to apply any required information (II) on the uncoated face 18*b* of each sheet.

FIG. 2 shows a section through such a CB sheet 18 which would normally be used as the top sheet of a multi-part set. The face 18*a* on which the coating (B) of colour-forming material is deposited is identified by the image (I) which is visible: through the coating (B), so that the uncoated face 18*b* can readily be identified to facilitate the subsequent application of the information (II) as required thereon.

To produce a CFB sheet as shown in FIG. 3, the face 10*b* of the web 10 will be coated with an appropriate receptor layer (F). This may, for example, be applied to the web 10 before it is formed into the roll 11 or before or after station 12 at which the image (I) is applied to the face 10*a* to which the colour-forming coating (B) is to be applied at the station 14.

After cutting the web into separate sheets 28 which carry the colour-forming coating (B) over the image (I) formed on the face 28*a* thereof, and which have the receptor coating (F) on the face 28*b* thereof, sheets 28 from the stack 30 of such CFB paper may then be fed through appropriate apparatus to reproduce the required information (II) on the face 28*b* having the receptor coating (F) thereon.

Whilst a sheet of CF material does not require a colour-former layer coating, the face opposite that on which the receptor layer coating (F) is formed may also be provided with a similar visible image, so that all sheets which are intended to form a multi-part set have such a visible image on one face.

However, it is to be understood that the image (I) applied to face 10*a* of the web is to be distinguished from the image (II) which is subsequently applied to the, uppermost face 18*b*,28*b* of the sheets produced from the web and serves one or more of several completely different purposes.

Thus, whilst the image (II) applied to the faces 18*b*,28*b* will be determined by the requirements of the end user, the printing applied to the face 10*a* will normally be determined by the requirements of the manufacturer and/or the subsequent printer.

One specific function which it is envisaged that the image (I) on the face 10*a* will serve is to identify the face 18*a*,28*b* of each sheet 18,28 which is to carry the colour-former coating (B) and thereby to indicate that this is the face on which the subsequent image (II) is not to be formed. It will be appreciated that the solutions of colour-formers used in carbonless copy processes are themselves substantially colourless, as are the micro capsules themselves or the continuous phase layer. Accordingly, the coating (B) generally has a substantial degree of translucency even when coloured, tinted or pigmented so that the image (I) printed on the face 10*a* before the application of the coating (B) can quite readily be discerned.

Thus, whilst the image (I) applied at station 12 could comprise detailed information, such as conditions of sale, required by the end user, as mentioned above, it is believed that the nature of the image (I) applied to face 10*a* will primarily be determined by the manufacturer for the purpose of identifying the coated face which is not subsequently to be subjected to printing, and/or to identify the material and/or the manufacturer.

Thus, in the simplest case, the printing applied to face 10*a* of the web may comprise a uniform single colour across the entire face of the web 10 in order to provide a clear distinction between the coated face 10*a* and the other face 10*b*. Where the paper of which the web 10 is formed is substantially white in colour, any arbitrary colour may be chosen for the printing applied to face 10*a* as this will serve the purpose of identifying the face 10*a* as that which carries the colour-former coating (B) in the stack of sheets subsequently produced. Indeed, different colours may deliberately be chosen for the purpose of identifying sheets to be used for ,different sheets in a multi-part set so as to assist in the subsequent printing of the appropriate information on the other face 10*b* during the manufacture of the multi-part sets. Such colour coding is of substantial benefit to the subsequent printer where different information requires to be printed on each sheet of a multi-part set. Insofar as different sheets of a multi-part set are often made from papers of different colours, it may be necessary to print the face 10*a* in different colours to contrast effectively with the base colour in each case, or to use an image of black or other very dark colour.

Where the paper is itself coloured, the printing applied to the face 10*a* should, of course, be in a clearly contrasting colour or for example a substantially darker shade of the same colour, so that in either case, the two faces of the sheet are readily distinguishable.

It will be appreciated that, instead of applying a single colour uniformly over the entire face 10*a*, the image (I) could be applied in the form of a pattern in one or more colours over all or only part of the face 10*a*. In this way, different grades of paper, could be identified. For example, the image (I) may consist of broad diagonal stripes each composed of a fine array of closely spaced small dots of a dark colour, with appropriate designations, such as CB, CFB or CF, similarly marked between the stripes, or within the width of the stripes for example by the omission of the dots in areas corresponding to the required letters or other indicia, as illustrated in FIG. 4.

Alternatively or additionally, the image (I) could include, an image serving the function of a water mark, trade mark or the like.

Due to the somewhat grainy nature of the coating, it would be difficult to discern through the coating an image in the form of information in a very small font, especially if printed in a relatively pale colour. However, there would be no difficulty in discerning information printed in a relatively dark colour and in characters greater than a certain minimum size determined by the characteristics of the CB coating itself.

Whatever the nature of the image (I) applied to the face 10*a*, and discernable through the colour-former coating (B), it provides a clear distinction between the colour-former coated face 18*a*,28*a* and the other face 18*b*,28*b* of the finished sheets 18,28 to which the subsequent image (II) is to be applied. Even where no such subsequent image is required, the image (I) applied to the face 10*a* under the colour-former coating (B) serves a useful purpose in identifying the CB face of the-finished sheet 18,28 in order to ensure that the sheets are correctly assembled into a multi-part set.

FIG. 5 illustrates the steps involved in one method of manufacturing a multi-part set comprising a top sheet 18 of CB material, a middle sheet 26 of CFB material and a bottom sheet 38 of CF material.

The stack 20 of sheets 18 of CB material formed by the process illustrated in FIG. 1 is placed in inverted position on a sheet feeder so that the uncoated face 18*b* is uppermost. Each sheet is then fed into a printing station P1 at which any required information or other image (II) is applied to the uncoated face 18*b*.

Similarly, the stack 30 of sheets 28 of CFB material, formed again by the process illustrated in FIG. 1 using feed stock having a receptor layer (F) coating on the face 10*b*, is placed in an inverted position on a sheet feeder so that the face 28*b* with the receptor layer coating (F) is uppermost. Each sheet is then fed into a printing station P2 at which the required information or other image (II) is produced on the face 28*b* on top of the receptor layer (F).

Likewise, a stack 40 of sheets 38 of CF material, which preferably has a visible image on the face 38*a* of each sheet, is placed on a sheet feeder with the face 38*b* with the receptor layer (F) uppermost and each sheet is fed into a printing station P3 at which any required image is produced on the face 38*b* on top of the receptor layer (F).

The printed sheets are then collected into sets 50, each comprising a top sheet 18 of CB material, with the printed face 18*b* uppermost and the colour-former coating (B) on face 18*a* lowermost, a middle sheet 28 of CFB material with the printed receptor layer (F) on face 28*b* uppermost and the colour-former coating (B) on face 28*a* lowermost, and a bottom sheet 38 of CF material with the printed receptor layer (F) on face 38*b* uppermost, and the uncoated face 38*a* lowermost. IT will be understood that printing may also be applied to the lowermost face 38*a* of the CF sheet 38 if required, preferably before the CF coating is applied to the face 38*b* thereof.

Images formed on the uppermost face 18*b* of the top (CB) sheet 18 by any process involving impact or localised pressure will be reproduced on the uppermost, face 28*b* of the CFB sheet 28 in addition to the image (II) previously printed on the; face 28*b* and likewise on the uppermost face 38*b* of the CF sheet 38 in addition to any image (II) thereon.

Instead of collating the various different sheets into multi-pan sets after the printing operation as described above, it is alternatively possible to form the various sheets into pre-collated sets and to arrange such sets into a stack before the printing operation is carried out. Sheets from such stack of precollated sets can then be passed through appropriate printing apparatus to produce the required information on the appropriate face of each sheet, i.e. that which does not carry the Colour-former coating (B). It will be appreciated that such a stack may comprise alternate CF and CB sheets to produce two-part sets, or sequences of CF and CB sheets separated by one or more CFB sheets to produce sets with more parts.

In such a case, the visible image (I) produced beneath the colour-former coating (B) provides a guide as to which side of each sheet should normally receive the printed information, i.e. the other side.

The application of the visible image (I) beneath the colour-former coating (B) does not, however, preclude the provision of an additional visible image on top of the coating, should this be required for any reason.

We claim:

1. A sheet of copy material of the type having on one face (18*a*;28*a*) thereof a coating (B) incorporating a colour-forming substance of the kind which when released onto a receptor material (F) produces a visible mark, and having an opposite face (18*b*:28*b*) of the material free from such coating, characterised in that said one face (18*a*;28*a*) of the material comprises a visible image (I) formed thereon before the deposition of said coating (B), which is translucent, so that said visible image (I) is discernible through said coating (B) and in that said opposite face (18*b*;28*b*) carries a further image (II) formed thereon after the deposition of said coating (B) on said one face (18*a*;28*a*).

2. A sheet of copy material according to claim 1 wherein the visible image (I) extends substantially uniformly over all or part of said one face (18*a*;28*a*) in order to afford a substantially uniform colour which is discernable through the coating (B).

3. A sheet of copy material according to claim 1 wherein the visible image (I) is of a substantially non-uniform nature: so as to present a pattern which is discernable through the coating (B).

4. A sheet of copy material according to claim 1 wherein the visible image (I) defines alpha-numeric or other characters so as to convey information discernable through the coating (B).

5. A sheet of copy material according to claim 1 wherein said substance comprises a substantially colourless colour-forming substance which reacts with said receptor material (F) to form said visible mark.

6. A sheet of copy material according to claim 5 wherein said colour-forming substance is contained in rupturable micro-capsules which comprise said coating (B) on said one face (18*a*;28*a*).

7. A sheet of copy material according to claim 5 wherein said colour-forming substance is contained in oil droplets emulsified into a rupturable continuous phase which comprises said coating (B) on said one face (18*a*;28*a*).

8. A sheet of copy material according to claim 5 wherein the opposite face (18*b*;28*b*) of the material carries a coating comprising said receptor material (F).

9. A sheet of copy material according to any one of claims 1, 2 to 8 wherein the material comprises paper.

10. A method of printing onto a sheet (18;28) of copy material as claimed in claim 1 wherein a plurality of said sheets are arranged into stack (20;30) in which all the sheets (18;28) have the respective faces (18*a*;28*a*) provided with the coating (B) facing towards the same end of the stack, by removing the sheets (18;28) successively from the stack (20;30) and passing them successively through printing apparatus whereby said further image (II) is printed on each of said opposite faces (18*b*;28*b*), the stack (20;30) being orientated in relation to the printing apparatus by reference to said visible image (I) on said one face (18*a*;28*a*) of that sheet (18;28) which is end-most in the stack.

11. A method of producing sheets of a copy material having on one face (18*a*;28*a*) thereof a coating (B) incorporating a colour-forming substance of the kind which when released on to a receptor material (F) produces a visible mark, and having an opposite face (18*b*;28*b*) thereof free from such coating, characterized by the steps of passing feed stock (10) free from said coating (B) on one face (10*a*) thereof successively and continuously through a first work station (12) at which a visible image (I) is formed on said one face (10*a*) and subsequently through a second work station (14) in which said coating (B), which is translucent, is applied to said one face (10*a*) and over said visible image (I), whereby said visible image (I) is discernable through said coating (B), severing said coated material (10") into a plurality of individual sheets (18;28) and forming said sheets (18;28) into a stack (20;30) in which the faces (18*a*;28*a*) of the sheets which bear said visible image (I) are all directed towards the same end of the stack (20;30), and subsequently forming a further image (II) on the opposite face (18*b*,28*b*) of said individual sheets (18;28) by removing said individual sheets (18;28) from the stack (20;30) and passing them through printing apparatus.

12. A method of printing onto a sheet (18;28) of copy material of the type having on one face (18*a*;28*a*) thereof a coating (B) incorporating a colour-forming substance of the kind which when released onto a receptor material (F) produces a visible mark, and having an opposite face (18*b*;28*b*) free from said coating; wherein a plurality of said sheets (18;28) are arranged into a stack (20;30) in which all of said sheets have said one face (18*a*;28*a*) provided with said coating (B) facing towards one end of the stack and wherein at said one end of the stack (20;30) at least one of said sheets has a visible image (I) formed on said one face (18*a*;28*a*) before the deposition of said coating (B) so that said visible image (I) is discernible through the coating (B) and visible at said one end of said stack, by removing the sheets (18;28) successively from the stack (20;30) and passing them successively through printing apparatus whereby said further image (II) is printed on each of said opposite faces (18*b*;28*b*), the stack (20;30) being oriented in relation to the printing apparatus by reference to said visible image (I) on said one face (18*a*;28*a*) of that sheet (18;28) which is end-most in the stack.

13. A carbonless copy material comprising:

a sheet of copy material having a first face (18*a*;28*a*) and an opposing second face (18*b*;28*b*);

a visible image (I) formed on said first face (18*a*;28*a*); and a translucent coating (B) disposed on said visible image, said coating including a colour-forming substance of the Kind which when released onto a receptor material, produces a visible mark, wherein said translucent coating enables said visible image (I) to be discernible therethrough.

14. The carbonless copy material according to claim 13, further comprising a receptor layer coating formed on said opposing second face, whereby said colour-forming substance produces a visible mark on said receptor layer coating in response to a mechanical pressure applied locally to said carbonless copy material.

* * * * *